United States Patent [19]

Schneble, Jr.

[11] 4,027,055

[45] May 31, 1977

[54] PROCESS OF TIN PLATING BY IMMERSION

[75] Inventor: Frederick W. Schneble, Jr., Oyster Bay, N.Y.

[73] Assignee: Photocircuits Division of Kollmorgan Corporation, Hartford, Conn.

[22] Filed: Apr. 14, 1975

[21] Appl. No.: 567,603

Related U.S. Application Data

[62] Division of Ser. No. 382,056, July 24, 1973, Pat. No. 3,917,486.

[52] U.S. Cl. ..... 427/98; 427/123; 427/259; 427/282; 427/304; 427/307; 427/309; 427/352; 427/353; 427/354; 427/368; 427/383 C; 427/405; 427/435; 427/436; 427/437; 106/1

[51] Int. Cl.[2] ..... B05D 5/12; C09D 5/00

[58] Field of Search ..... 427/98, 123, 307, 309, 427/435, 405, 436, 437, 282, 259, 383 C, 304, 368, 353, 352, 354; 106/1

[56] References Cited

UNITED STATES PATENTS

| | | | |
|---|---|---|---|
| 2,369,620 | /1944 | Sullivan | 427/436 |
| 2,891,871 | 6/1959 | Ceresa | 106/1 |
| 2,976,169 | 3/1961 | Streicher | 427/436 |
| 3,303,029 | 2/1967 | Shipley | 106/1 |
| 3,672,923 | 6/1972 | Zeblisky | 106/1 |

FOREIGN PATENTS OR APPLICATIONS

| | | | |
|---|---|---|---|
| 151,552 | 1962 | U.S.S.R. | 427/436 |

*Primary Examiner*—Michael F. Esposito
*Attorney, Agent, or Firm*—Morgan, Finnegan, Pine, Foley & Lee

[57] ABSTRACT

The present invention relates to a novel immersion tin bath composition and a novel and improved method of depositing a smooth, even, metallic tin coating over metallic surfaces, providing improved solderability.

30 Claims, No Drawings

PROCESS OF TIN PLATING BY IMMERSION

This is a division of application Ser. No. 382,056 filed July 24, 1973, now U.S. Pat. No. 3,917,486.

BACKGROUND OF THE INVENTION

Methods are well-know to plate tin over metallic surfaces. The instant baths and methods are to be distinguished from the techniques based upon electrolytic deposition and electroless plating.

Electrolytic plating is the production of adherent deposits of metals on conductive surfaces carried out by passage of electric current through an electroplating solution. The plating rate is determined by the current density impressed on the surface being plated.

Electroless plating is a method of metal deposition without the assistance of an external supply of electrons but, requiring an agent present in the processing solution capable of reducing the ions to be deposited. The process is further characterized by the catalytic nature of the surface which enables the metal to be plated to any thickness. Typically, such solutions comprise a solvent, a supply of ions of the metal to be deposited, an agent capable of reducing the ions of the metal to be deposited, a complexing agent for the ions of the metal to be deposited, and a pH regulator.

Among other problems, a major difficulty is sometimes encountered with depositing electroless metal on closely defined areas. There is a tendency for non-sensitive areas after prolonged immersion in or contact with electroless metal solutions to receive scattered or random metal deposits. In addition, the electroless metal solutions sometimes produce metal deposits which contain a substantial amount of hydrogen causing the deposits to be brittle, breaking under rough mechanical handling and bending.

Immersion plating or contact plating depends, however, upon a galvanic displacement reaction. The current instead of being furnished from an outside source, arises from reaction of the substrate itself and the metal being plated. Because of this, metal thickness has traditionally been limited to 10 to 50 millionths of an inch. As the immersion process depends upon the electrolytic action of the base metal, deposition stops as soon as the base metal is entirely covered forming a very thin deposit.

SUMMARY OF THE INVENTION

This invention is concerned with immersion plating and its attendant advantages which include, among others: immersion deposits which are decidedly adherent; deposits with considerable resistance to corrosion; the production of dense impervious deposits; and the ability to deposit metal on closely defined areas of metallized surface.

It has been found that up to about 300 millionths of an inch of tin can be plated in accordance with the present invention to provide surprisingly good solderability immediately after plating and particularly, after exposure to adverse conditions often required in subsequent fabrication.

Additionally, the high quality of solderability provided by this invention endures for a period in excess of six months of storage under normal stock room conditions.

Moreover, the chemical resistance of the tin plate of the present invention is surprisingly excellent. The tin plate remains solderable after exposure to normal printed circuit processing chemicals i.e., chromic acid, dilute hydrochloric acid, etc., and will remain bright after cleaning with trichloroethylene, Freon, isopropyl alcohol and other normal flux-removing solvents.

It has additionally been discovered that optimum solderability is achieved by the present invention with plating thicknesses of only between 50–100 millionths inch. Plating of greater thickness under the present invention is now possible by merely extending the immerison time of the plating process. However, it has been found that such greater thicknesses do not improve the solderability characteristics to any appreciable degree. The tenacious tin plate achieved by the present invention achieves much greater solderability characteristics than even thicker tin plates formed by other processes. The much improved solderability with relatively thin plate thickness, therefore, proves to be a great economic saving.

Accordingly, the present invention has the following objects.

It is an object of the present invention to provide an immersion tin plating bath effective in plating over normally inadequate thicknesses of copper and other metallized surfaces, particularly that produced by ductile electroless copper.

It is another object of the present invention to provide a new immersion tin plating bath which will not attack solder masks and other material on the surfaces of the board to be plated.

It is a further object of the present invention to provide a new method of depositing tin by contact or immersion plating in greater thickness than has heretofore been accomplished, in an amount up to about 300 millionths of an inch.

It is an additional object of the present invention to provide a method of improving the solderability characteristics of printed circuitry.

It is still a further object of the present invention to provide a method of depositing a smooth, even, tin coating to surface metal increasing its resistance to shelf aging and corrosive chemicals.

Other objects and advantages of the invention will be set forth in part hereinafter and in part will be obvious herefrom, or may be learned by practice with the invention.

DETAILED DESCRIPTION OF THE PREFERRED EMBODIMENTS

According to the present invention, there are provided immersion tin plating bath compositions for depositing a smooth, even tin coating on metallized surfaces, comprising a soluble stannous salt, a sulfur component, a mineral acid, and a wetting agent. The metal of the substrate surface must have an electronegativity greater than tin in order that it be capable of chemically displacing tin from the tin bath.

A further preferred feature of the invention is to provide a process for depositing a smooth, even tin coating on a metallized surface said process comprising immersing into a tin plating bath comprising a soluble stannous salt, a sulfur component which comprises at least two sulfur containing compounds, a mineral acid, and a wetting agent, an article having a metallized surface capable of chemically displacing tin from the tin plating bath, wherein the article is immersed in the bath until tin forms in a continuous coating on said metallized surface.

A still further preferred embodiment of the invention is in a process for the manufacture of printed circuit boards having a smooth, even tin coating over areas of clean copper circuitry having grease-free and oxide-free copper surfaces, comprising the steps of:

1. immersing said circuit boards into an agitated immersion tin plating bath comprising a soluble stannous salt, a sulfur component, a mineral acid, and a wetting agent for such time until a continuous coating of tin forms on said copper surfaces;
2. rinsing said boards, and
3. drying said boards.

THE BATH

Immersion tin baths are not new and have been used for many years, particularly in decorative plating. The combination of a stannous salt and HCl has been known, but such a bath proves inadequate in the plating of tin over metal circuitry. For one thing, the tin plated surface was found to be porous and crystalline on the copper substrate. It has been now discovered that by adding a wetting agent to this composition, a beautiful, smooth plate can be achieved which yields exceptionally improved tin thickness. It has also been found that the addition of a sulfur component aids in removal of impurities and secondary reaction products and generally enhances the stability of the bath. The tin bath of the present invention is capable of forming a tin plate up to about 300 millionths of an inch being so non-porous it can act as an etch resist. The result is improved plating and a more efficient bath.

Among the stannous salts found operable in the present invention include soluble organic and inorganic acid salts of tin. While applicant does not limit himself to any specific stannous salt, illustrative of those contemplated within this invention are stannous salts of halides, nitrates, acetate, boron-fluoride complexes, and sulfates.

Organic anionic, non-ionic and cationic surface active agents have been found useful as the wetting agents in the present invention. Preferred wetting agents include fluorinated carboxylic acids such as FC-98, manufactured by the Minnesota Mining and Manufacturing Company and the Triton-X series of wetting agents manufactured by the Rohm and Haas Company.

The acids effective in the present invention are strong inorganic and organic acids. The preferred inorganic acids are the mineral acids such as hydrochloric acid, sulfuric acid, nitric acid and phosphoric acid. Useful organic acids include, for example, acetic acid and formic acid.

The sulfur component useful in the present invention includes organic and inorganic sulfur-containing compounds. The sulfur component comprises at least two sulfur-containing compounds. Examples of organic compounds include aliphatic sulfur-nitrogen compounds, such as thiocarbamates, e.g. thiourea; 5-membered heterocyclics containing S-N in the 5-membered ring, such as, thiazoles and isothiazoles; dithiols, e.g., 1,2-ethanedithiol; 6-membered heterocyclics containing S-N in the ring such as thiazines, e.g., 1,2-benzisothiazine, benzothiazine; thioamine acids such as methionine, cystine, cysteine; and, thio derivatives of alkyl glycols. Examples of inorganic compounds include alkali metal sulfides, alkali metal thiocyanates and alkali metal dithionates.

It is important however, that no matter what sulfur compounds are used, alkali metal polysulfides should be present within a certain limited range of concentrations, preferably between about 0.005 to about 0.2 g/l of the total bath composition.

Commercial imported thiourea is often used to prepare the plating bath of the present invention. Commercial imported thiourea is distinguished from, for example, reagent grade thiourea as the commercial grade has a greater concentration of sulfides present. An example of such a commercial grade thiourea is that manufactured by the DeGussa Company.

It has been found that when a fresh bath has been prepared and a commercial imported thiourea has been used as the sulfur component, a greenish-brown precipitate is formed. Articles in the plating bath plate unacceptably for about the first hour. It has been found that when this precipitate is eliminated as by filtration, plating can be accomplished, but an unacceptable crystalline tin deposit forms. It has been found that if after the precipitate is removed there is added an alkali metal polysulfide of the general formula, $M_2S_x$, wherein $x$ is a number from 2 to 5, in amounts of about 0.005–0.2 g/l of the bath composition, the tin bath composition is capable of depositing a smooth, even tin coating.

Where reagent grade or chemically pure thiourea is used, no precipitate is formed but a granular tin plating occurs which is very porous and unacceptable. While no filtering is necessary, the addition of an alkali metal polysulfide of the general formula $M_2S_x$, where $x$ is from 2 to 5 in an amount between 0.005–0.2 g/l will cause the tin bath composition to plate a smooth, even tin coating. If too much of the poysulfide compound is used, a dull brownish plate will be formed instead of the normal semi-matte silver-white coating. This dullish brown plate is easily cleaned, however, with a solution of potassium chloride.

It is therefore seen that the addition of a specified amount of an alkali metal polysulfide to the tin plating bath causes unusually and unexpectedly smooth, lustrous plating. Where commercial grade thiourea is used, which actually contains appreciable and varying amounts of sulfides, such sulfides must be eliminated first to allow the additon of a known quantity of polysulfides. Where a reagent grade thiourea is used which does not contain appreciable amounts of sulfides, no filtering step is necessary and the specified amount of alkali metal polysulfides may be added directly.

The immersion tin plating bath may be formulated in either of two procedures. First, de-ionized or distilled water in an amount equivalent to about 70% of the required final bath volume is heated to the bath operating temperature of 50°–80° C. The chemicals as discussed above are added while stirring. After the chemicals are added, the remainder of water is added to bring the bath to full volume.

THE PLATING PROCESS

With respect to the process, in order for successful tin plating to be accomplished, the copper or other metallized surface on a panel or board must be free from grease and oxide films. The industry generally uses many types of cleaning cycles. The treatment afforded the surface to be plated depends upon the cleanliness of the material to be treated and associate factors. Scrubbing with conventional alkaline cleaners is used to remove heavy soils. Oxides may be removed from the metal surfaces by application thereto of a dilute acid solution such as dilute sulfuric hydrochloric acid, or a light etching solution such as a 25% solution of ammonium persulfate in water. Often both of these solutions may be employed, separated with a water rinse step. The treatment period and temperature of this cleaning cycle are significant, in that elevated temperatures and extended periods of time may result in removal not only of the oxide materials but of the metal itself. The panel or board containing the metal surface is rinsed thoroughly after this cleaning step with water to remove all residue of etching compounds. Care should be taken to avoid the formation of further oxide film during rinsing as a result of air oxidation.

If the condition of the materials permits, a sanding operation with a fine abrasive can also be used to remove oxides.

The boards or panels containing the metal surfaces are usually transported from process to process on racks. In view of the nature of the immersion tin baths special precaution must be taken as to the choice of the material of these racks. Polypropylene or coated stainless steel racks are recommended. Uncoated stainless steel racks can be used for short runs, but as the bath contains a sulfur compound, caution should be taken to prevent contamination of the rack and fouling of the bath. Racks made of iron and other metals easily attacked by corrosive acids such as hydrochloric acid should also be avoided.

The immersion tin bath must be agitated when in use to prevent localized starved spots. Air agitation should not be used but, rack agitation proves quite effective. Mild agitation for a minute upon entering the bath solution ensures uniform coverage. Also found very effective is the use of a propellor mixer, sufficient to circulate solution through a rack without introducing air.

The tin plating bath of the present invention is generally operated at a temperature of 50°–80° C. Storing the bath composition at temperatures of 50° C or higher tends to accelerate the decomposition of thiourea. However, it should be noted that at temperatures below about 50° C, the chemicals begin to salt out of the solution.

Upon formulation and heating, the bath should be a pale green color. The color will gradually turn to a coffee color, usually after two to three hours. During this transitional period of coffee color, parts should not be plated.

The color change is believed to be due to the formation of a precipitate, stannous sulfide. The precipitate will do-deposit on any parts being plated during the transitional period, causing grey-black deposits and occasionally a rust-colored dusty deposit. These deposits can easily be removed by a light brushing of the part with water. However, a dust-free, deposit-free operation may be accomplished by completely removing the precipitate by filtering the hot bath solution through a 10 micron glass filter. Again, it is noted that if the solution cools below 50° C, it will salt out.

The bath should remain covered when not in use to avoid iron or alkaline contamination.

When the copper surface being plated becomes grey and spotty, the bath is depleted and should be either discarded or re-activated.

The effective life of the tin plating bath of course, depends upon many factors. It has been found, however, that when the bath is operated at its preferred conditions, e.g. 60° C± 5° C and it is at its preferred formulation, the bath will plate 30–35 square feet of copper area per gallon of bath with tin 70–80 millionths inch thick. The preferred operating conditions and bath formulations (in Example 2 below) were used in the compilation of data for this analysis. It is therefore seen that it would take about 40 minutes of immersion plating time to achieve a tin coating of 80 millionths of an inch thickness.

After the panels have plated to the desired thickness, the rack is transferred to a water rinse. The use of warm water is recommended to ensure complete removal of plating salts and to avoid staining upon drying. Poor rinsing is the primary cause of stained and dull tin plated circuits. A typical effective rinsing operation comprises a warm water rinse of 100°–120° F for five minutes.

After rinsing, the panels may be routinely air dired, or more preferably be either forced air dried using clean air or a warm oven bake operated at temperatures of approximately 150°–300° F.

The normal thickness of tin plating (about 80 millionths inch) will withstand optional mild brushing such as wire brushing or optional light pumice brushing. Such optional wire brushing will provide a pleasing shiny appearance and minimize fingerprint as well as other stains. In addition, optional wire brushing provides the most solderable surface. Optional Scotchbrite brushing will also yield fine results when set at as light a pressure as possible. In all such optional brushing operations, the machines should be thoroughly cleaned and free of contaminants such as sulfuric acid, copperbrite, etc. Such contaminants can eventually oxidize the tin surface.

EXAMPLE I

Precleaning Cycles

The typical process will begin with a pre-cleaning cycle to insure that the copper or other metallic surfaces to be plated are grease and oxide free. The cleaning cycle used usually depends upon the degree of contamination of the surface. A typical mild pre-cleaning cycle would comprise the following steps for the designated time periods:

| | | |
|---|---|---|
| (a) | Altrex Soak* | 5 minutes (150° F–180° F) |
| (b) | Water rinse | 1 minute |
| (c) | 10% $H_2SO_4$ dip | 30 seconds |
| (d) | Water rinse | 1 minute |

*Altrex is the tradename of a mild alkaline detergent manufactured by Wyandotte Chemicals Corp., Wyandotte, Michigan.

While the above pre-cleaning cycle is usually quite adequate a stronger cleaning cycle is also often used consisting of the following steps:

| | | |
|---|---|---|
| (a) | Ammonium persulfate dip (25% APS at 120° F) | 30 seconds |
| (b) | Water rinse | 1 minute |
| (c) | 10% $H_2SO_4$ dip | 15 seconds |
| (d) | Water rinse | 1 minute (allow to drain) |

EXAMPLE II

An immersion tin plating bath was prepared in accordance with the present invention as indicated below:

| | |
|---|---|
| Stannous chloride | 21 g/l |
| Thiourea** | 90 g/l |

-continued

| | |
|---|---|
| Concentrated HCl (37% aqueous) | 36 ml/l |
| FC-98 | 0.5 g/l |
| Potassium polysulfides*** | 0.1 g/l |
| Deionized water | Balance |

**Chemically pure grade
***Sulfurated potash as manufactured by the Fisher Scientific Company.

In the above formulation FC-98 is a fluorinated carboxylic acid wetting agent manufactured by the Minnesota Mining and Manufacturing Company. The bath formulated above was 12 liters (3.18 gallons).

After being pre-cleaned in accordance with the mild pre-cleaning cycle of Example I above, circuit boards were immersed on racks into the tin plating bath formulated above. These circuit boards contained the following copper surface areas:

| No. of Boards | Dimensions | = Copper Surface Area |
|---|---|---|
| 24 pcs. | 2½" × 8" | 6.67 sq. ft. |
| 135 pcs. | 6" × 8" | 89.33 sq. ft. |
| 31 pcs. | sample circuits | 5.00 sq. ft. |
| | | 101.00 sq. ft. |

The bath was operated at a temperature of 65° C with initial agitation by vibration of the racks. The boards were removed from the bath after 40 minutes and several microsections were made of the plated boards. The results indicated the average plated thickness of the tin was 80 millionths inch.

The yield of the bath was then calculated, based upon the volume of the bath, 12 liters or 3.18 gallons, and the average surface plate thickness of 80 millionths inch:

$$\frac{101 \text{ sq. ft}}{3.18 \text{ gal.}} = 32 \text{ sq. ft./gal.}$$

Therefore, the bath of the above formulation operated at the above conditions yielded a tin plate of 80 millionths inch thick over 32 square feet of copper per gallon of bath.

To determine the optimum and maximum life of the plating bath additional experiments were made increasing the surface area of copper in the tin bath. It was found that when more than 101 sq. ft. of copper surface was immersed into the 3.18 gallon bath, the copper surface became grey and spotty indicating the bath was depleted before it could adequately plate the copper surfaces. Therefore, it is seen that 32 sq. ft. of copper surface per gallon of bath represents an optimum yield.

While the above examples are illustrative of the tin plating bath composition and process of tin plating, variations of the process and compositions have proved equally as effective. For example, the components in the preferred composition of the tin bath may be present in the following ranges of concentration based upon the total bath composition:

| | | |
|---|---|---|
| Stannous salt | 15 – 30 | g/l |
| Sulfur component | 15 – 120 | g/l |
| Mineral Acid | 25 – 50 | ml/l |
| Wetting agent | 1 – 10 | g/l |
| Water | Balance | |

It is noted that the sulfur component comprises an alkali metal polysulfide and at least one other sulfur compound as described earlier. The ratio between the polysulfide and the other sulfur compounds comprising the sulfur component can vary widely. For example, where polysulfides are present with only one other sulfur-containing compound, the ratio of the former to the latter may be between about 0.004% to 1.3%. Solder masks and legends can be applied either before or after tin plating. If the solder mask is applied before tin plating, traditional and customary techniques may be employed but with special precaution to employ a sufficient cure of the mask before the plating operation. The solder mask should be applied over a clean, wire brushed surface. A single pass through the gas-fired oven at 250° F is not a sufficient cure to withstand the subsequent contact with the tin bath. Insufficient cure will cause the solder mask to blister in the tin bath. The following bakes enumerated below are merely illustrative of the minimum bakes which have proved quite adequate in protecting the solder mask during tin bath procedure:

a. 2 passes through a gas-fired over at 250° F
b. 30 minutes at 250° F oven bake
c. 15 minutes at 320° F oven bake Application of the solder mask over the plated tin is done in the same manner as solder masking over solder plate. However, the tin under the solder mask will reflow upon prolonged exposure to molten solder, in excess of 8 seconds. The tin re-flow causes the solder mask to wrinkle. This is the same phenomenon as observed with the mask over solder.

Legends are best applied after tin plating. The problem with legends applied prior to tin plating is limited to where legends are applied directly to a copper surface. The tin bath tends to lift off legends where they adhere to copper.

If the legend is applied over the epoxy mask or the base material only, no lifting will occur in the tin bath. Legends generally will remain their normal color during 40 minutes exposure to the tin bath. White legend may tint a very pale green, but the color change is almost imperceptible.

The tin plating process of the present invention may be accomplished on circuit boards containing areas of nickel gold plating. The preferred procedure is to first screen a clear mask over the nickel-gold fingers. Then the boards are cleaned in accordance with the pre-cleaning cycle hereinabove discused and plated with tin. After the tin plate and rinsing procedures, the fingers may be stripped by conventional procedures including Blakeslee strip.

An alternative procedure for tin plating a board containing nickel-gold fingers is to first tape the fingers in the conventional manner. Commonly available platers tape may be used and applied firmly to fingers to avoid solution creepage. The boards are then cleaned in accordance with the pre-cleaning cycle hereinabove described, tin plated, rinsed and finally the tape is removed.

It has been found that high quality solderability has been achieved after exposure of 50–80 millionths inch of tin plate after the following conditions:

1. Humidity conditioning at 35° C and 90% relative humidity for 96 hrs;

2. Baking at 320° F for 1 hour, or 250° F for 2 hours or 3 passes through Gas Fired Oven at 250° F or 120° F for 3 hours;
3. Exposure to 35° C temperature and 90% relative humidity for 10 days.

Additionally, the high quality of solderability provided by this invention extends for long periods of time.

The invention in its brodest aspects is not limited to the specific steps, processes and composition shown and described but departures may be made therefrom within the scope of the accompanying claims without departing from the principles of the invention and without sacrificing its chief advantages.

What is claimed is:

1. A process for depositing a smooth, even tin coating on a metallized surface, said process comprising immersing into a tin plating bath comprising a soluble stannous salt, a sulfur component which comprises a mixture of alkali metal polysulfides and at least one other sulfur-containing compounds, a mineral acid, and a wetting agent, wherein said alkali metal polysulfides are present in sufficient amount to produce said smooth, even coating an article having a metallized surface capable of chemically displacing tin from the tin plating bath, wherein the article is immersed in the bath until tin forms in a continuous coating on said metallized surface.

2. The process as defined in claim 1 wherein the stannous salt is selected from the group consisting of stannous salts of halides, sulfate, fluoborate, nitrate and acetate; the wetting agent is selected from the group consisting of organic anionic, non-ionic and cationic surfactants; and said mineral acid is selected from the group consisting of hydrochloric acid, sulfuric acid, nitric acid and phosphoric acid.

3. The process as defined in claim 1 wherein said stannous salt is stannous chloride, said sulfur component contains thiourea and alkali metal polysulfides, said mineral acid is hydrochloric acid and said wetting agent is a fluorinated carboxylic acid.

4. The process of claim 3 wherein the alkali metal polysulfides are present at a concentration of 0.005 to 0.2 g/l of the bath composition.

5. The process as defined in claim 3 wherein the ingredients of said tin plating bath are present in the following concentrations:

| | | |
|---|---|---|
| Stannous chloride | 21 | g/l |
| Thiourea (chemically pure) | 90 | g/l |
| Alkali metal polysulfide | 0.1 | g/l |
| Hydrochloric acid | 36 | mg/l |
| Fluorinated carboxylic acid | 0.5 | g/l |
| Water | Balance | |

6. The process as defined in claim 3 wherein said fluorinated carboxylic acid is present in a concentration of from about 0.1 to about 5 g/l.

7. The process as defined in claim 1 wherein said bath is operated at a temperature of 50°–80° C.

8. The process as defined in claim 1 wherein said sulfur-containing compounds are selected from organic and inorganic sulfur compounds, said organic sulfur compounds selected from the group consisting of aliphatic sulfur-nitrogen compounds,
5- and 6-membered heterocyclic compounds containing S-N in the ring,
dithiols,
thio derivatives of alkyl glycols,
thioamine acids; and said inorganic sulfur compounds selected from the group consisting of alkali metal sulfides, alkali metal thiocyanates, and alkali metal dithionates.

9. The process as defined in claim 1 wherein said tin plating bath comprises the components in the following concentrations:

| | | |
|---|---|---|
| Soluble stannous salt | 15 – 30 | g/l |
| Sulfur component | 15 – 120 | g/l |
| Mineral acid | 25 – 50 | ml/l |
| Wetting agent | 0.1 – 10 | g/l |
| Water | Balance | |

10. The process as defined in claim 8 wherein said sulfur component is present in an amount of 50–120 g/l.

11. The process as defined in claim 1 wherein said sulfur component contains thiourea and alkali metal polysulfides and wherein said alkali metal polysulfides are present in the range of 0.005 to 0.2 g/l of the bath composition.

12. A process for the manufacture of printed circuit boards having a smooth, even tin coating over areas of clean copper circuitry comprising the steps of:

1. immersing said circuit boards into an agitated immersion tin plating bath comprising a stannous salt, a sulfur component which comprises a mixture of alkali metal polysulfides and at least one other sulfur-containing compound, a mineral acid, and a wetting agent, wherein said alkali metal polysulfides are present in sufficient amount to produce said smooth, even coating until tin forms in a continuous coating on said copper circuitry;
2. rinsing said boards; and
3. drying said boards.

13. The process as defined in claim 12 wherein the plating of tin in said tin plating bath is continued to a thickness of between about 50 and 300 millionths of an inch.

14. The process as defined in claim 12 wherein said tin plating bath is operated at a temperature of 50°–80° C.

15. The process as defined in claim 12 including a pre-cleaning cycle which is a mild etching process comprising the steps of (1) soaking the circuit boards in an alkaline cleaner, (2) rinsing the boards in water (3) dipping the boards in a 10% sulfuric acid solution and thereafter (4) rinsing the boards again in water.

16. The process as defined in claim 12 including a pre-cleaning cycle which is a strong etching process comprising the steps of (1) immersing said circuit boards into an etchant dip wherein said etchant is ammonium persulfate, (2) rinsing with water, (3) dipping into a 10% sulfuric acid solution and (4) rinsing said board in water.

17. The process as defined in claim 12 wherein said rinsing step comprises rinsing said circuit boards in warm water at a temperature of about 100° F–120° F.

18. The process as defined in claim 12 wherein said drying step comprises a warm oven bake operated at a temperature between about 200° F–250° F.

19. The process as defined in claim 12 wherein after the drying step said boards are wire brushed.

20. The process as defined in claim 12 wherein before said pre-cleaning step a solder mask is applied to the circuit boards and said circuit boards are then cured sufficiently to prevent blistering during the tin plating step.

21. The process as defined in claim 12 wherein said sulfur-containing compounds are selected from organic and inorganic sulfur compounds, said organic sulfur compounds selected frpom the group consisting of aliphatic sulfur-nitrogen compounds, 5- and 6-membered heterocyclic compounds containing S-N in the ring, dithiols, thio derivatives of alkyl glycols, thioamine acids; and said inorganic sulfur compounds selected from the group consisting of alkali metal sulfides, alkali metal thiocyanates, and alkali metal dithionates.

22. The process as defined in claim 12 wherein said sulfur component contains thiourea and alkali metal polysulfides and wherein said alkali metal polysulfides are present in the range of 0.005 to 0.2 g/l of the bath composition.

23. The process as defined in claim 12 wherein in the tin plating bath the stannous salt is selected from the group consisting of stannous salts of halides, sulfate, fluoborate, nitrate, and acetate; the wetting agent is selected from the group consisting of organic anionic, nonionic and cationic surfactants; and said mineral acid is selected from the group consisting of hydrochloric acid, sulfuric acid, nitric acid, and phosphoric acid.

24. The process of claim 23 wherein the alkali metal polysulfides are present at a concentration of 0.0005 to 0.2 g/l of the bath composition.

25. The process as defined in claim 23 wherein said tin plating bath comprises the components in the following concentrations:

| | | |
|---|---|---|
| Soluble stannous salt | 15 – 30 | g/l |
| Sulfur component | 15 – 120 | g/l |
| Mineral acid | 25 – 50 | ml/l |
| Wetting agent | 0.1 – 10 | g/l |
| Water | Balance | |

and wherein the alkali metal polysulfides of the sulfur component is present at a concentration of 0.005 to 0.2 g/l of the bath composition.

26. The process as defined in claim 12 wherein said tin plating bath comprises stannous chloride, thiourea, alkali metal polysulfides, hydrochloric acid and fluorocarboxylic acid wetting agent.

27. The process as defined in claim 26 wherein said fluorocarboxylic acid is present in a concentration of from about 0.1 to about 5 g/1.

28. The process as defined in claim 26 wherein the ingredients of said tin plating bath are present in the following concentrations:

| | | |
|---|---|---|
| Stannous chloride | 21 | g/l |
| Thiourea (chemically pure) | 90 | g/l |
| Alkali metal polysulfides | 0.1 | g/l |
| Hydrochloric acid | 36 | mg/l |
| Fluorocarboxylic acid | 0.5 | g/l |
| Water | Balance | |

29. The process as defined in claim 12 wherein said tin plating bath comprises the components in the following concentrations:

| | | |
|---|---|---|
| Soluble stannous salt | 15 – 30 | g/l |
| Sulfur component | 15 – 120 | g/l |
| Mineral acid | 25 – 50 | ml/l |
| Wetting agent | 0.1 – 10 | g/l |
| Water | Balance | |

30. The process as defined in claim 29 wherein said sulfur component is present in an amount of 50–120 g/l.

* * * * *